US006998522B2

(12) United States Patent
Niitsuma

(10) Patent No.: US 6,998,522 B2
(45) Date of Patent: Feb. 14, 2006

(54) KEYBOARD INSTRUMENT

(75) Inventor: Shinji Niitsuma, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 10/744,817

(22) Filed: Dec. 23, 2003

(65) Prior Publication Data

US 2004/0159202 A1 Aug. 19, 2004

(30) Foreign Application Priority Data

Jan. 23, 2003 (JP) ..... 2003-014997

(51) Int. Cl.
*G10C 1/00* (2006.01)

(52) U.S. Cl. ..... 84/174

(58) Field of Classification Search ..... 84/423 R, 84/433, 434, 436, 440, 174
See application file for complete search history.

(56) References Cited

U.S. PATENT DOCUMENTS 6,087,574 A * 7/2000 Kitashima et al. ..... 84/423 R

FOREIGN PATENT DOCUMENTS

JP 2000-122660 4/2000

* cited by examiner

*Primary Examiner*—Kimberly Lockett
(74) *Attorney, Agent, or Firm*—Davis & Bujold, P.L.L.C.

(57) ABSTRACT

A keyboard instrument is provided which inhibits generation of unintended, audible noise. A partition (body part) is arranged between adjacent hammers corresponding to keys. In the keyboard instrument provided with the partition, even if the keyboard instrument is rotated vertically and a hammer falls, the partition prevents the hammer from freely falling and striking adjacent hammers. Also, the hammer is restricted from generating unintended sounds for reasons unrelated to falling. Accordingly, generation of an unintended audible sound of the hammers can be reliably restrained in the present keyboard instrument.

13 Claims, 5 Drawing Sheets

PRIOR ART

KEYBOARD INSTRUMENT

BACKGROUND OF THE INVENTION i) Technical Field of the Invention

This invention relates to a keyboard instrument.

ii) Description of the Related Art

A conventional keyboard instrument 200 used in an electronic piano comprises a key 210, a hammer 220 and a chassis 230, as shown in FIG. 5. Among the above components, the chassis 230 is provided above a key bed 240, supported by two supports 250 provided on a player side and on a non-player side. An intermediate part of the chassis 230 is supported by a rib 260 extending between the two supports 250. On a top face of the chassis 230, a total of 88 keys 210 are disposed in parallel so that a free end of the respective keys 210 can swing up and down on the player side with respect to the keyboard instrument 200 and the other end can pivot on the top face of the chassis 230 on the non-player side.

The hammers 220, one each being provided per key 210, are disposed in parallel on a bottom face of the chassis 230 corresponding to an arrangement direction of the keys 210. Each hammer 220 has a free end provided with a plummet 225, and is disposed in such a way that the free end of the hammer 220 can swing up and down on the player side with respect to the keyboard instrument 200. The other end of the hammer 220 can swing about the intermediate part of the chassis 230 between the player side and the non-player side. More particularly, the chassis 230 has an insertion hole 231 provided closer to the player side than the intermediate part of the chassis 230. The hammer 220 is configured so that the free end is positioned below the chassis 230 on the player side and the other end is positioned near the top face of the chassis 230 via the insertion hole 231. The hammer 220 is further provided with a pivot shaft 226 on the other end thereof, and a tail part 221 extending further to the non-player side beyond the pivot shaft 226. The hammer 220 is attached to the chassis 230 via the pivot shaft 226. The key 210 comprises a protrusion 211 for pressing down the tail part 221 when the key is depressed. The keyboard instrument 200 further comprises a rubber switch 270 positioned between a mounting face below the top face of the chassis 230 and the tail part 221.

In the keyboard instrument 200 constituted as above, when a key 210 is depressed, the tail part 221 is depressed by the protrusion 211, and further the switch 270 is depressed by the tail part 221. As a result, a control device not shown generates a musical sound, and the free end of the hammer 220 provided with the plummet 225 swings upward. The movement of the hammer allows a player to feel as if he/she is playing an acoustic piano although he/she is playing an electronic instrument, as disclosed in Unexamined Japanese Patent Publication No. 2000-122660.

However, if the keyboard instrument 200 is rotated vertically (so that either side of the key in the key arrangement direction goes under the other side), the hammer 220 is likely to fall due to the weight of the plummet 225. Accordingly, there are cases in which one hammer 220 generates an unintended noise by hitting the adjacent hammers 220. Inhibiting such a noise is a very important task for providing a sophisticated keyboard instrument.

SUMMARY OF THE INVENTION

One object of the present invention is to provide a keyboard instrument which does not generate unintended noise.

In order to attain the above object, the present invention provides a keyboard instrument having a chassis disposed above a key bed and having a plurality of keys arranged in parallel on a top face thereof. A plurality of corresponding hammers on a bottom face of the chassis are arranged in parallel in the key arrangement direction. A free end of each hammer swings up and down in conjunction with each depression of the key, and a partition is provided between the hammers.

In the keyboard instrument of the present invention, even if the keyboard instrument is disposed vertically, the partition prevents the hammers from falling. Accordingly, the hammers do not hit each other, and subsequently do not generate a hitting sound.

Accordingly, the keyboard instrument of the present invention can reliably restrict a cause of unintended noise generation, that is, the hitting together of the hammers.

The partition may be as large as needed to separate the adjacent hammers within a range of a swing of a hammer, but the partition may also be larger. The partition may be disposed between each of the respective hammers, or between every predetermined number or interval of hammers.

The partition can be positioned anywhere, as long as it can prevent the hammer from falling. It is preferable that the partition faces the plummet attached to the free end of the hammer.

Even if the partition prevents the hammer from falling, additional unintended noise may be generated due to collisions between the partition and the hammer. Accordingly, it is preferable that a cushioning material is arranged on a side face of the partition directly opposite to the hammer. Then, it is possible to inhibit the sounds of collisions from being generated when the hammer strikes the partition. It is preferable that the cushioning material is also arranged on a side face of the hammer directly opposite the partition.

There is no limitation on how to fit the partition in the keyboard instrument. The partition may be integrally formed on the bottom face of the chassis. Then, the chassis and the partition can be molded together, resulting in an improved manufacturing efficiency.

Another cause of unintended noise generated by the hammer is a sound generated when the hammer, raised by key depression, subsequently falls. This unintended noise is not as large as the sound of the hammers hitting together. However, it is problematic since the unintended noise is generated after a sounding stop. Accordingly, it is preferable that the keyboard instrument of the present invention further comprises receiving means disposed below the hammer for receiving the free end of the falling hammer. Also preferable is a cushioning material provided on a receiving face of the receiving means for receiving the hammer and on an abutting face of the hammer opposite the receiving face. As a result, the cushioning materials strike each other when the hammer falls, causing a buffering effect to be exerted efficiently and effectively. Therefore, it is possible to inhibit the unintended noise, which may arise by the falling hammer, from being generated after the sounding stop.

It is preferable that the receiving face of the receiving means has a slope which is angled with respect to the key bed. With a keyboard instrument configured with this preference, when the hammer falls, the hammer hits the slope and slides on the receiving face. The falling speed of the hammer is gradually decreased due to the friction and generation of a hitting sound is substantially restrained. Accordingly, this keyboard instrument can reliably inhibit unintended sound generation, which may arise by the falling hammer, after the sounding stop. It is more preferable that the abutting face of the hammer also has a slope which is inclined with respect to the key bed.

The chassis of the present keyboard instrument has three legs which abut the key bed on the player side, the non-player side, and at an intermediate part between the player side and the non-player side. It is also preferable that a cushioning material used for inhibiting the generation of an unintended sound is layered on the face of the intermediate part abutting a key bed leg. In the case of such a three-legged chassis, if the key bed drops down, the leg on the intermediate part is detached from the key bed. When a key is depressed, the chassis makes noise by striking the key bed. However, if the cushioning material is arranged on the face of the intermediate part abutting the key bed leg, generation of unintended noise created by the chassis hitting the key bed can be avoided even if the key bed falls away.

Almost any soft and/or resilient material can be used for the cushioning material. However, felt is preferred.

BRIEF DESCRIPTION OF THE DRAWING

By way of example, the invention will now be described with reference to the accompanying drawings in which.

DETAILED DESCRIPTION OF PREFERRED EMBODIMENT

Figure 1:
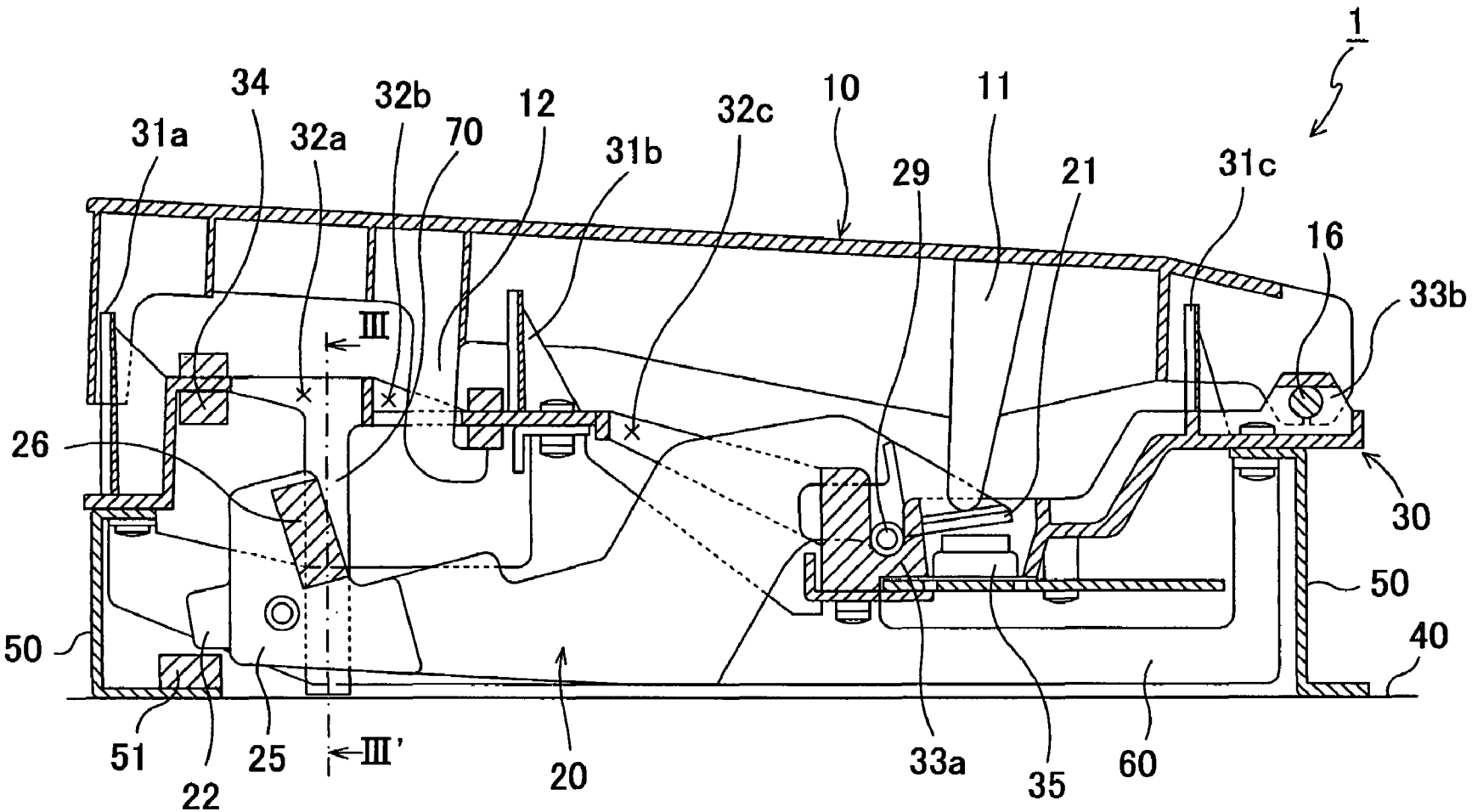
FIG. 1 is a lateral sectional view of a keyboard according to a first embodiment.

Referring to FIG. 1, a keyboard instrument 1 of the present embodiment comprises a key 10, a hammer 20 and a chassis 30. In this keyboard instrument 1 the chassis 30 is lifted above a key bed 40 to a predetermined height by two supports 50 provided on a player side and a non-player side, respectively. An intermediate part of the chassis 30 mounting a later-explained first bearing part 33*a* thereon, is supported by a rib 60 extending between the two supports 50. The key 10 is attached to the chassis 30 so as to pivot on a top face of the chassis 30. The hammer 20 is attached to the chassis 30 so as to swing between the top of the chassis 30 and the key bed 40.

A total of 88 keys 10 are disposed in parallel on the top face of the chassis 30 (arranged in a line along a direction perpendicular to the surface of the FIG. 1 drawing paper). A free end of the key 10 in the longitudinal direction swings up and down on the player side (the left hand side in FIG. 1) of the keyboard instrument 1. A pivot shaft 16 is provided on the other end of the key 10 in the longitudinal direction is pivotally attached to a later-explained second bearing part 33*b*. The second bearing part 33*b* is provided on the chassis 30 on the non-player side (the right hand side in FIG. 1) of the keyboard instrument 1.

A protrusion 11, and a rebound inhibitor 12, are formed on a bottom side of the each key 10. The protrusion 11 is positioned where it can depress a later-explained tail part 21 of the hammer 20. The rebound inhibitor 12 has a tip shaped substantially like a hook, and is positioned where the tip can be inserted into a later-explained second insertion hole 32*b*.

A hammer 20 is provided for each key 10. The hammers 20 are disposed in parallel to each other corresponding to the arrangement direction of the keys 10. The hammers 20 are positioned along the bottom face of the chassis 30. Each hammer 20 has a free end and is disposed in such a way that the free end on the player side in the longitudinal direction swings between the chassis 30 and the key bed 40. The other end of the hammer 20 in the longitudinal direction is pivotally attached to the first bearing part 33*a* on the top side of the chassis 30. The chassis 30 is provided with later-explained third insertion holes 32*c*, and the free end of the hammer 20 is disposed between the chassis 30 and the key bed 40 on the player side through the respective third insertion holes 32*c*.

Figure 2:
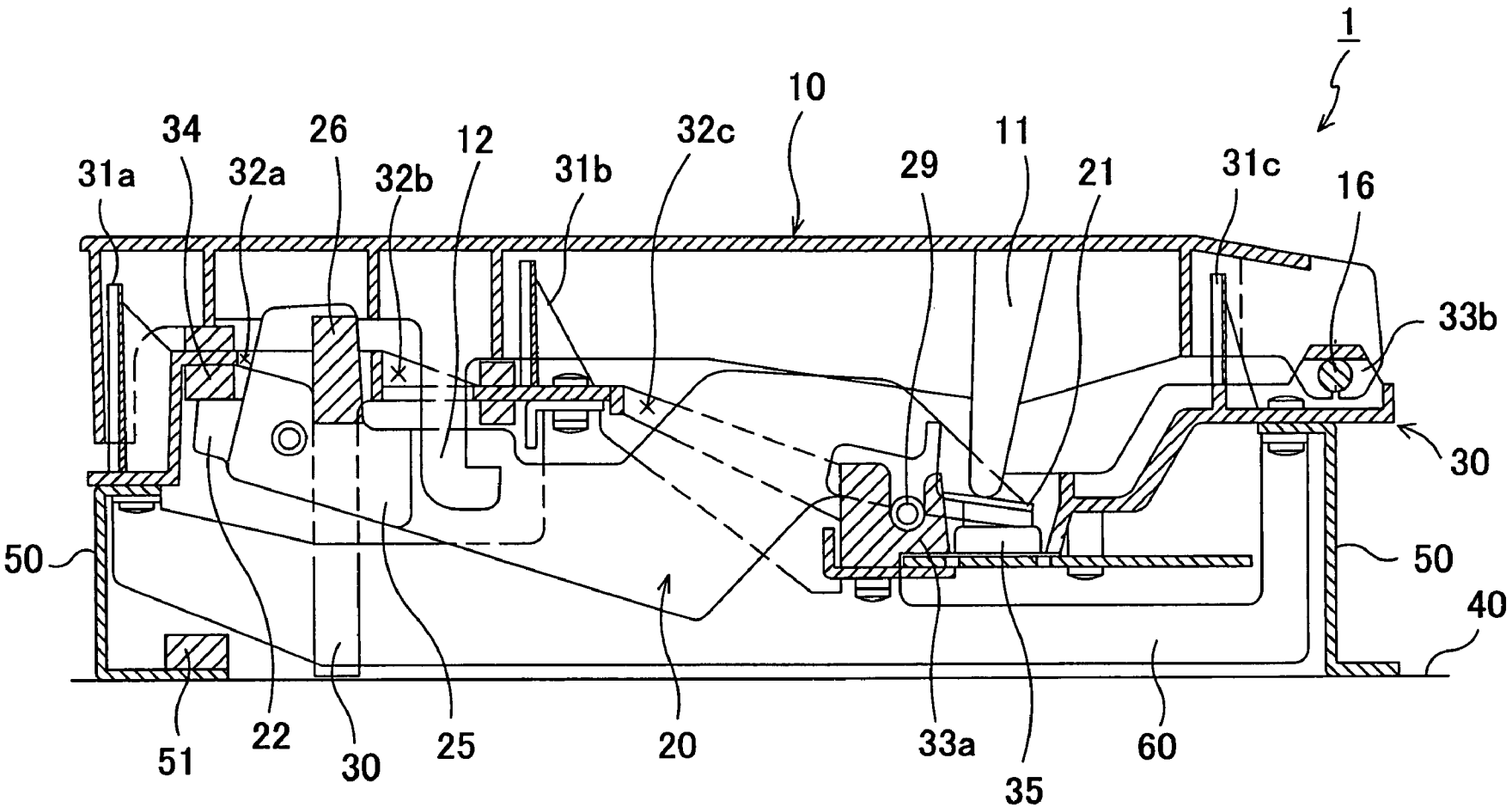
FIG. 2 is a lateral sectional view of a keyboard according to the first embodiment.
Figure 3:
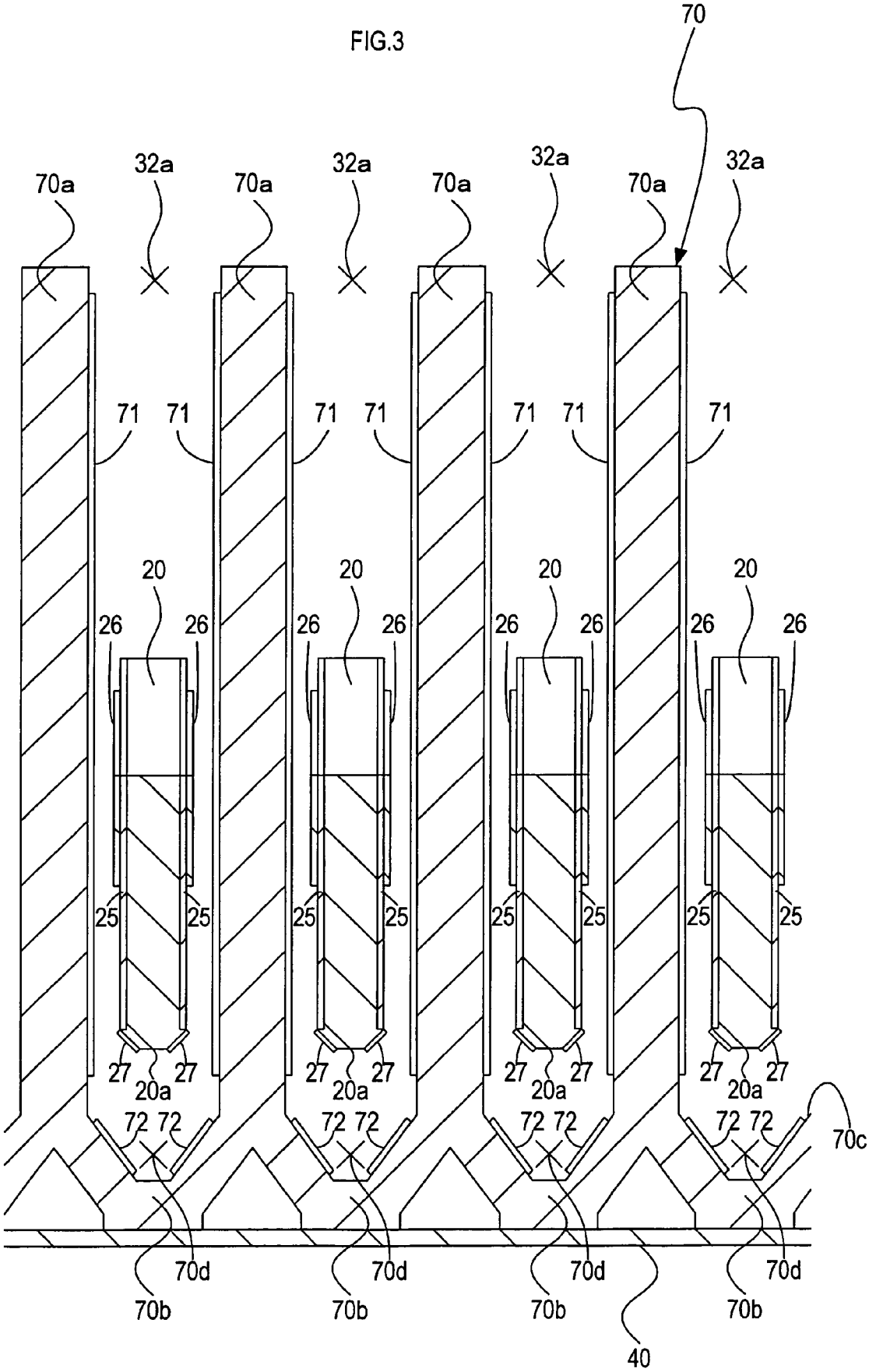
FIG. 3 is a sectional view of the keyboard taken along the line III–III' in FIG. 1.

A hammer 20 comprises a tail part 21 extending beyond a pivot shaft 29 toward the non-player side. A plummet 25 is attached to both side faces of the free end of the hammer 20 opposite to body parts 70*a* of a later-explained partition 70 (see FIG. 3). A protruding part 22 is provided on the player side of the hammer 20 extending further longitudinally than the plummet 25. Felt 26 is layered on the plummet 25. Specifically, the felt 26 is layered so as to oppose the partition 70 at all times, even when the protruding part 22 abuts on a bottom dead-point felt 51 and the hammer 20 is positioned at a bottom dead-point. The felt 26 is also layered so as to oppose the partition 70 when the protruding part 22 abuts on a top dead-point felt 34 and the hammer 20 is positioned at a top dead-point as shown in FIG. 2, and also when the hammer 20 is swinging between the bottom dead-point and the top dead-point. As shown in FIG. 3, a part 20*a* of the hammer 20, facing a later-explained receiving face 70*c*, has a slope which is angled with respect to the key bed 40 when the hammer 20 is at rest. The angle of part 20*a* is readily seen when viewed from a cross section perpendicular to a longitudinal direction (i.e. right and left direction in FIG. 1) of the hammer 20. Particularly, the part 20*a* is nearly in the form of a wedge capable of engaging a later-explained groove 70*d*. Felt 27 is also layered on this part 20*a*.

The chassis 30 is formed preferably by injection molding of synthetic resin. It is nearly in the form of a plate extending along the arrangement direction of the keys 10. A first displacement inhibitor 31*a* is provided on a top face of an end on the player side of the chassis 30 and extends upward for inhibiting displacement of the keys 10 in the arrangement direction of the keys 10. On the non-player side of the first displacement inhibitor 31*a*, a first insertion hole 32*a* is formed as shown in FIG. 2 for inserting the free end of the hammer 20 upon key depression. Further along on the non-player side of the first displacement inhibitor 31*a*, a second insertion hole 32*b* is formed for inserting the rebound inhibitor 12 of the key 10. On the non-player side of the second insertion hole 32*b*, a second displacement inhibitor 31*b*, extending upward, is provided. Additionally, on the non-player side of the second displacement inhibitor 31*b*, a third insertion hole 32*c* is formed for inserting the hammer 20. On the non-player side of the third insertion hole 32*c*, the first bearing part 33*a* is formed for pivotally supporting the hammer 20. Below the tail part 21, on the non-player side, a rubber switch 35 is provided for detecting key depression. On the non-player side of the rubber switch 35, a third displacement inhibitor 31*c*, extending upward, is provided. On the non-player side of the third displacement inhibitor 31*c* and on an end of the non-player side of the chassis 30, a second bearing part 33*b* is formed for pivotally supporting the key 10. A top dead-point felt 34 is provided on the bottom face of the upper part of chassis 30 between the first displacement inhibitor 31*a* and the first insertion hole 32*a*. The protruding part 22 of the hammer 20 abuts the top dead-point felt 34 upon full key depression. The position of the hammer 20 where the protruding part 22 abuts the top dead-point felt 34 is referred to as the top dead-point of the hammer 20.

The partition 70 comprises a body part 70*a* and a receiving part 70*b* as shown in FIG. 3. The body part 70*a* extends downward along both sides of each key 10 in the arrangement direction. The body part 70*a* is preferably located substantially near the edge of the second insertion hole 32*b* of the chassis 30 and is disposed between each of the respective hammers 20. The receiving part 70*b* is positioned below the hammer 20 (as shown in FIG. 3), and serves to connect the bottom ends of each of the adjacent body parts 70*a*.

Felt 71 is adhered to the parts of a set of body parts 70*a* facing the plummet 25 of the hammer 20. The receiving part 70*b* has a slope which is angled with respect to the swinging direction of the hammer 20. Particularly, a groove 70*d* is formed which is nearly V-shaped when viewed from a cross section taken perpendicular to the longitudinal direction of the hammer 20 (see FIG. 3). Felt 72 is layered on both slant receiving faces 70*c* of the groove 70*d*. In FIG. 3, the receiving face 70*c* is only labeled on the right side because of limitations of the drawing space. However, the remaining parts all having felt 72 thereon also correspond to the receiving face 70*c* in the present embodiment.

As shown in FIG. 1, a cross section of the support 50 on the player side is substantially in the form of a U-shape opening toward the non-player side. The support 50 on the non-player side is in the form of essentially a Z-shape. The support 50 on the player side is provided with the bottom dead-point felt 51 disposed on a tip of a lower hem. The lower hem extends a little longer than an upper hem and the bottom dead-point felt 51 is substantially below the top dead-point felt 34. The protruding part 22 provided on a tip of the free end of the hammer 20 rests on the bottom dead-point felt 51 when the key is not depressed. The position of the hammer 20 where the protruding part 22 abuts on the bottom dead-point felt 51 is termed the bottom dead-point of the hammer 20.

In the keyboard instrument 1 constituted as above, when the key is released, the hammer 20 descends to a position where it is held by the bottom dead-point felt 51 and the receiving part 70*b* due to the weight of the plummet 25. Along the descent, the tail part 21 reciprocally pushes up the key 10 by way of the protrusion 11.

On the other hand, when the free end of the key 10 is depressed, the protrusion 11 depresses the tail part 21 and the free end of the hammer 20 moves upward. Accordingly, the weight of the hammer 20 is transmitted to the player as the touch of key depression.

In the keyboard instrument 1 described above, even if the keyboard instrument 1 is rotated vertically, the partition 70 prevents the hammer 20 from falling. Therefore, collisions between the adjacent hammers 20 are avoided and the unintended generation of a hitting sound of the hammers can be reliably restrained.

The keyboard instrument 1 of the present embodiment inhibits the generation of an unintended, extraneous sound caused by the hammers 20.

In the keyboard instrument 1 of the present embodiment, a portion of the partition 70 facing the hammer 20 and conversely, a portion of the plummet 25 facing the partition 70, has felt 26 and 71 layered thereon. Therefore, an unintended, audible sound generated when the hammer 20 hits the partition 70 is inhibited.

The partition 70 is integrally formed on the bottom face of the chassis 30. Since the partition 70 and the chassis 30 are simultaneously molded, manufacturing efficiency is improved.

In the present embodiment, the receiving part 70*b* is provided below the hammer 20. The felt 72 is layered on both of the receiving faces 70*c* of each of the receiving parts 70*b*, and conversely, the felt 27 is layered on the faces of the hammer 20 opposite to the receiving face 70*c*. When the hammer falls, the felt serves as a cushioning material allowing a buffering effect to be exerted efficiently and effectively. Accordingly, the keyboard instrument 1 of the present embodiment can inhibit the generation of an audible sound formerly generated after the sounding stop by the falling hammer 20.

Furthermore, the slant groove 70*d* is formed in the receiving part 70*b*, and the abutting face of the hammer 20 facing the groove 70*d* is in a form capable of being engaged with the groove 70*d*. When the hammer 20 is received by the receiving part 70*b*, the hammer 20 slides on the receiving face 70*c* and the hammer 20 fits into the receiving part 70*b*. The falling speed of a hammer 20 is gradually decreased due to friction. Accordingly, generation of an audible sound can be effectively inhibited.

[Second Embodiment]

Now, a keyboard instrument is described in a second embodiment according to the present invention.

The majority of components of the present embodiment are identical to those described in the first embodiment. Therefore, only the different components will be described in detail hereafter, and the explanation of the identical components may not be repeated.

Figure 4:
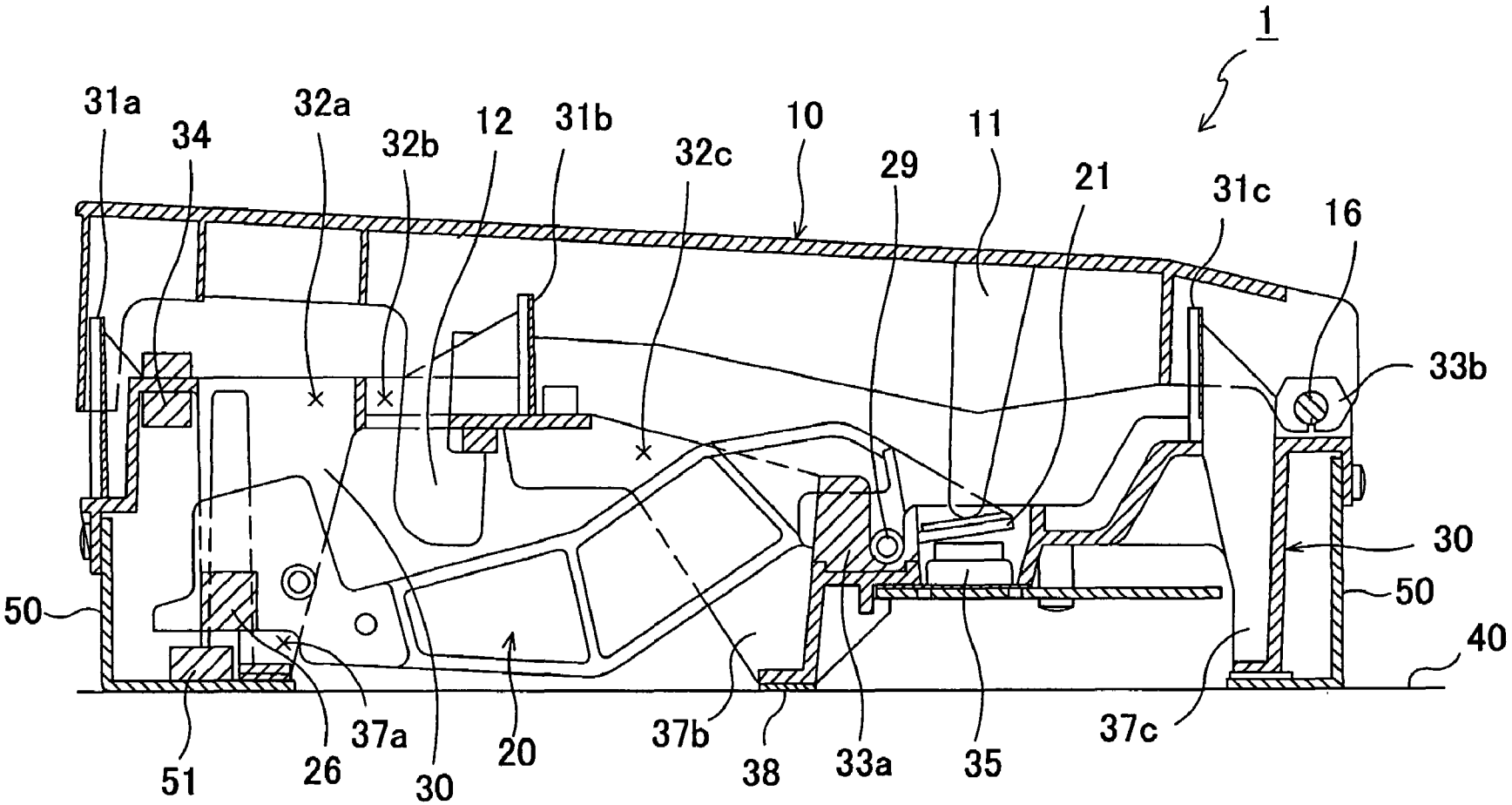
FIG. 4 is a lateral sectional view of a keyboard according to a second embodiment.
Figure 5:
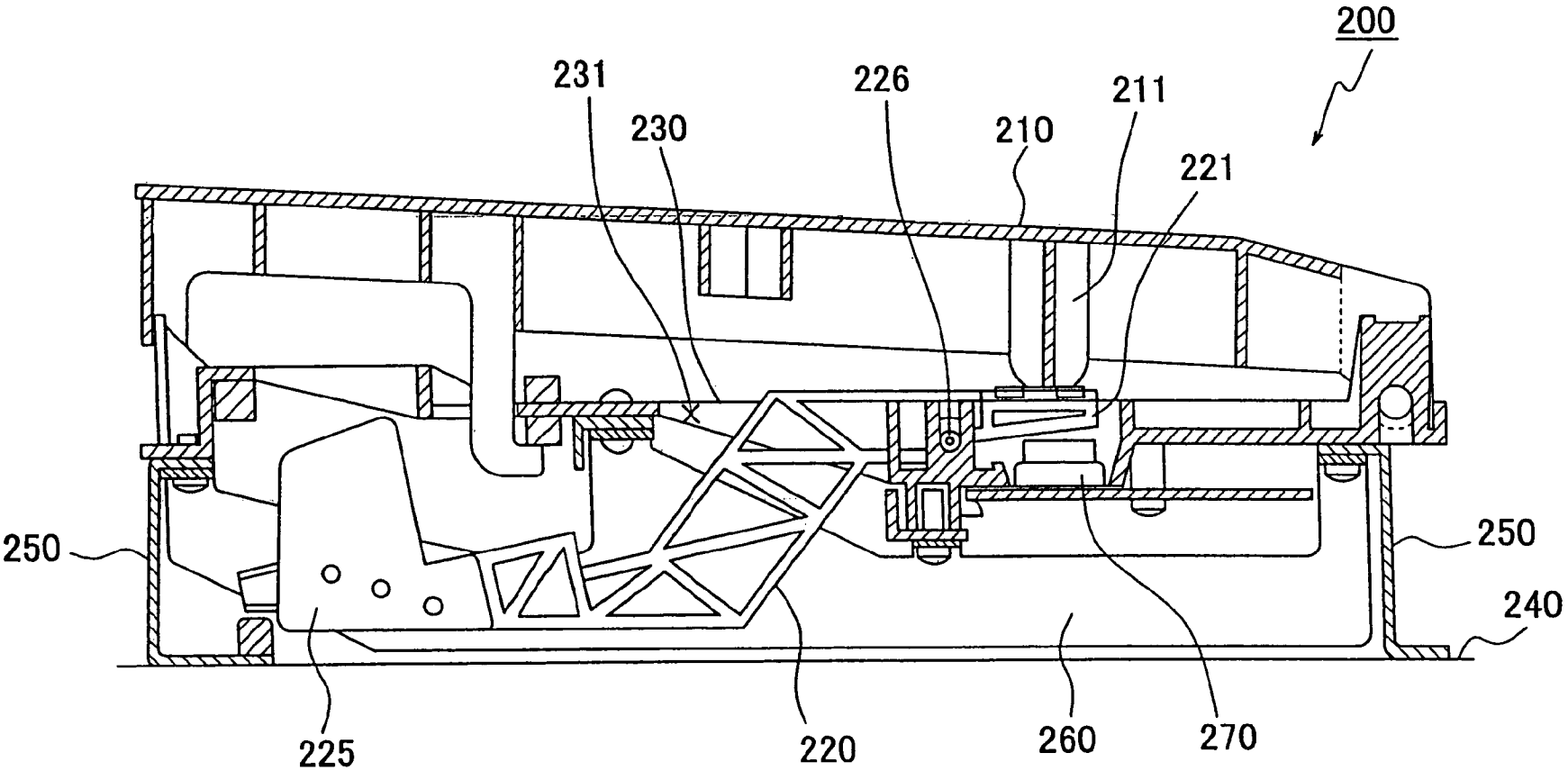
FIG. 5 is a lateral sectional view of a conventional keyboard.

Referring to FIG. 4, one difference between the keyboard instrument 1 of the present embodiment and that of the first embodiment is that the present embodiment comprises legs 37*a*, 37*b*, 37*c*, abutting the key bed 40 on the player side, the non-player side, and at the intermediate part of the chassis 30 between the player side and the non-player side. Additionally, the present embodiment has felt 38 layered on the bottom face of the leg 37*b* of the intermediate part abutting the key bed 40.

In the case of such a three-legged chassis 30, the key bed 40 may fall away from the chassis 30 causing the intermediate leg 37*b* to become detached from the key bed 40. Upon key depression, the chassis 30 may subsequently strike the key bed 40. However, if the felt 38 is layered upon the bottom face of intermediate leg 37*b* between the leg 37*b* and the key bed 40, generation of unintended noise created by the chassis 30 hitting the key bed 40 can be avoided, even if the key bed 40 falls away from the chassis 30.

The present invention is not limited to the above embodiments, and other modifications and variations may be possible without departing from the technical scope of the invention.

For instance, other soft or cushioning materials along with combinations of materials (such as urethane foam, rubber, artificial covering, fabric, lycra, teflon, silk, satin, nylon, cotton, and combinations of the above) may be used instead of the felt in the above embodiments.

As for another instance, receiving part 70*b* located below hammer 20 is shown in FIG. 3 as forming a slanted, substantially V-type configuration matching the lower part of the free end of hammer 20. However, the two pieces, the receiving part 70*b* and the hammer 20, do not have to have corresponding substantially V-type configurations in order to frictionally engage each other. For example, one piece may be in the form of a substantially U-type configuration while the other may be formed of essentially horizontal and vertical surfaces (as oriented in FIG. 3).

What is claimed is:

1. A keyboard instrument comprising:

a chassis disposed above a key bed and having a plurality of keys arranged in parallel on a top face thereof; and a plurality of hammers correspondingly arranged in parallel along a key arrangement direction on a bottom face of the chassis and a free end of each hammer swinging up and down in conjunction with each key depression of the key;

wherein a partition is provided between at least two of said hammers;

said partition is provided between portions of the free ends of the hammers, and directly opposing faces of a partition and hammer comprise a partition and hammer interface; and a cushioning material is arranged on at least one of the opposing faces of each partition and hammer interface.

2. The keyboard instrument according to claim 1, wherein said partition opposes a plummet attached to said free end of the hammer.

3. The keyboard instrument according to claim 2, wherein a cushioning material is arranged on each opposing face of a partition and hammer interface.

4. The keyboard instrument according to claim 3, wherein said partition is provided between each hammer.

5. The keyboard instrument according to claim 4, wherein said keyboard instrument further comprises a receiving part disposed below the hammer for receiving the free end of the hammer.

6. The keyboard instrument according to claim 5, wherein a cushioning material is arranged on at least one of an opposing face of the hammer and the receiving part.

7. The keyboard instrument according to claim 6, wherein the opposing faces of the hammer and the receiving part are arranged and constructed to frictionally engage each other.

8. The keyboard instrument according to claim 7, wherein a cushioning material is arranged on each frictionally engaging opposing face of the hammer and the receiving part.

9. The keyboard instrument according to claim 8, wherein said chassis further comprises a plurality of support legs, and at least one support leg directly abutting the key bed, and at least one cushion member is disposed between directly opposing surfaces of the at least one support leg and the key bed.

10. The keyboard instrument according to claim 9, wherein at least one of said support legs is located near a player side of the instrument, at least one of said support legs is located near a non-player side of the instrument, and at least one of said support legs is located intermediately in a range between limits defined by the player and non-player side of the instrument, and said at least one cushion member is disposed between directly opposing surfaces of the at least one support leg located intermediately and the key bed.

11. The keyboard instrument according to claim 10, wherein said cushion member comprises a fabric.

12. The keyboard instrument according to claim 11, wherein said cushion member comprises a felt material.

13. The keyboard instrument according to claim 9, wherein said partition is integrally formed on the bottom face of said chassis.

* * * * *